United States Patent [19]

Kohlstette

[11] 4,305,817

[45] Dec. 15, 1981

[54] SELF-EMPTYING CLARIFYING DRUM

[75] Inventor: Werner Kohlstette, Oelde, Fed. Rep. of Germany

[73] Assignee: Westfalia Separator AG, Oelde, Fed. Rep. of Germany

[21] Appl. No.: 158,770

[22] Filed: Jun. 12, 1980

[30] Foreign Application Priority Data

Jun. 29, 1979 [DE] Fed. Rep. of Germany ..... 2926237

[51] Int. Cl.[3] ..... B04B 11/00

[52] U.S. Cl. ..... 210/104; 210/114; 210/37.1; 233/19 A

[58] Field of Search ..... 210/86, 103, 104, 114, 210/369–375; 233/19 A, 19 R, 20 A, 20 R, 27

[56] References Cited

U.S. PATENT DOCUMENTS

| | | | |
|---|---|---|---|
| 3,189,268 | 6/1965 | Nilsson | 210/86 X |
| 3,420,374 | 1/1969 | Umeda | 210/86 X |
| 3,642,196 | 2/1972 | Nilsson | 210/371 X |
| 3,805,956 | 4/1974 | Mercier | 210/103 X |

*Primary Examiner*—John Adee

*Attorney, Agent, or Firm*—Sprung, Felfe, Horn, Lynch & Kramer

[57] ABSTRACT

A self-emptying clarifying drum has a first paring disk disposed in a first paring chamber for the removal of the clarified liquid and an automatically operating apparatus for sensing the solids level in the separating chamber of the drum. The apparatus includes a plurality of passages formed between the drum cover and a separating plate and which lead from the separating chamber to a second paring chamber provided with a second paring disk for the removal of a small portion of the clarified liquid. The outlet passage of the second paring disk is in communication with the outlet for the clear phase and is connected to a flow measuring apparatus which is coactive with a control apparatus for effecting the discharge of solid matter from the drum. The plurality of passages include at least one first passage for the removal of a small portion of clarified liquid having a larger outlet cross-section and leading from the outer margin of the separating plate and at least one second passage of smaller outlet cross-section leading from a further inwardly located margin of the separating plate. The first and second passages are in communication with each other and the portion of the clarified liquid which is to be removed through these passages is led through the flow measuring apparatus by the second paring disk disposed in the second paring chamber. The flow measuring apparatus is provided with two switch actuating points for effecting control in dependence on the consistency of the solid matter.

3 Claims, 2 Drawing Figures

SELF-EMPTYING CLARIFYING DRUM

BACKGROUND OF THE INVENTION

The invention relates to a self-emptying clarifying drum having a paring disk disposed in a paring chamber for the removal of the clarified liquid, and an automatically operating apparatus for sensing the level of solids in the separating chamber of the drum, this apparatus consisting of a plurality of passages formed by a separating plate and the drum cover and leading from the separating chamber to a paring chamber provided with a paring disk for the derivation of a small portion of the clarified liquid, the outlet passage of the paring disk being connected on the one hand to the outlet of the clarifying phase and on the other hand to a measuring device which in turn cooperates with a control apparatus for the initiation of the discharge of the solids from the drum.

Self-emptying clarifying drums of this construction are known, for example, from German *Offenlegungsschrift* No. 2,436,285, and they are used for the purpose of initiating partial or complete discharge operations of the drum whenever a predetermined amount of solids has collected in the separating chamber of the drum. For this purpose, during the clarifying process in the drum a small portion of clarified liquid is continuously fed through one or more passages leading from the separating chamber and formed by segment-shaped chambers separated from one another by ribs between the drum cover and the separating plate and is conveyed to a paring chamber equipped with a paring disk. The liquid removed by this paring disk is fed to a measuring device, e.g., a flow meter, and delivered to the clear phase outlet. The flow meter is connected to a control apparatus which starts a partial or complete emptying of the drum whenever the rate of flow in the flow meter decreases. For this purpose an actuation point is provided on the flow meter. The rate of flow in the flow meter diminishes whenever the solid matter spun out in the separating chamber has collected up to the outer edge of the separating plate and thus blocks the passages disposed above the separating plate.

The outer diameter of the separating plate and thus the inlet to the passages determines the permissible volume of the spun-out solids and thus prevents the solids from accumulating to the point of contact with the plate stack disposed in the drum. The permissible volume of removable solids in the drum is primarily determined by their nature, i.e., their consistency, since otherwise the complete discharge of the solids from the drum would not be assured. The volume of the allowable amount of solids can be no more than small in the case of dense solids, but in the case of bulky solids it can be larger.

The disadvantage of the known self-emptying clarifying drums of the above-named type of construction is that the volume of removable solids is determined by the outer inlet cross section of the passages and hence by the separating plate diameter, and is based on the solids that are the hardest to discharge. In these known clarifying drums, accordingly, only a very specific amount of solids can be discharged, which often is too small without replacing the separating plate, resulting in the necessity of a great number of emptying operations if the content of solids in the liquid is great. Losses of clarified liquid nevertheless often occur in the emptying operations, especially in the total emptying of the drum.

SUMMARY OF THE INVENTION

It is the object of the invention, therefore, to construct the known self-emptying drum such that it will be possible to gather and also discharge varying amounts of solid matter depending on the consistency of that solid matter, so that fewer emptying operations will be necessary.

This object is accomplished in accordance with the invention in that one or more passages for the derivation of a small portion of the clarified liquid lead through a larger outlet cross section from an outer edge of the separating plate and one or more passages of smaller outlet cross section lead from a further inwardly located edge of the separating plate, the passages being in communication with one another and the portion of the clarified liquid that is to be derived through these passages is fed by the paring disk disposed in the derivation paring chamber through a measuring apparatus provided with two actuation points.

With this construction in accordance with the invention, it is possible to spin out a different volume of solid matter and discharge it automatically, according to the consistency of the solid, without the need to modify or replace parts in the drum.

BRIEF DESCRIPTION OF THE DRAWING

An embodiment of the invention will be described hereinbelow in conjunction with the drawing, wherein.

DETAILED DESCRIPTION OF THE INVENTION

Figure 1:
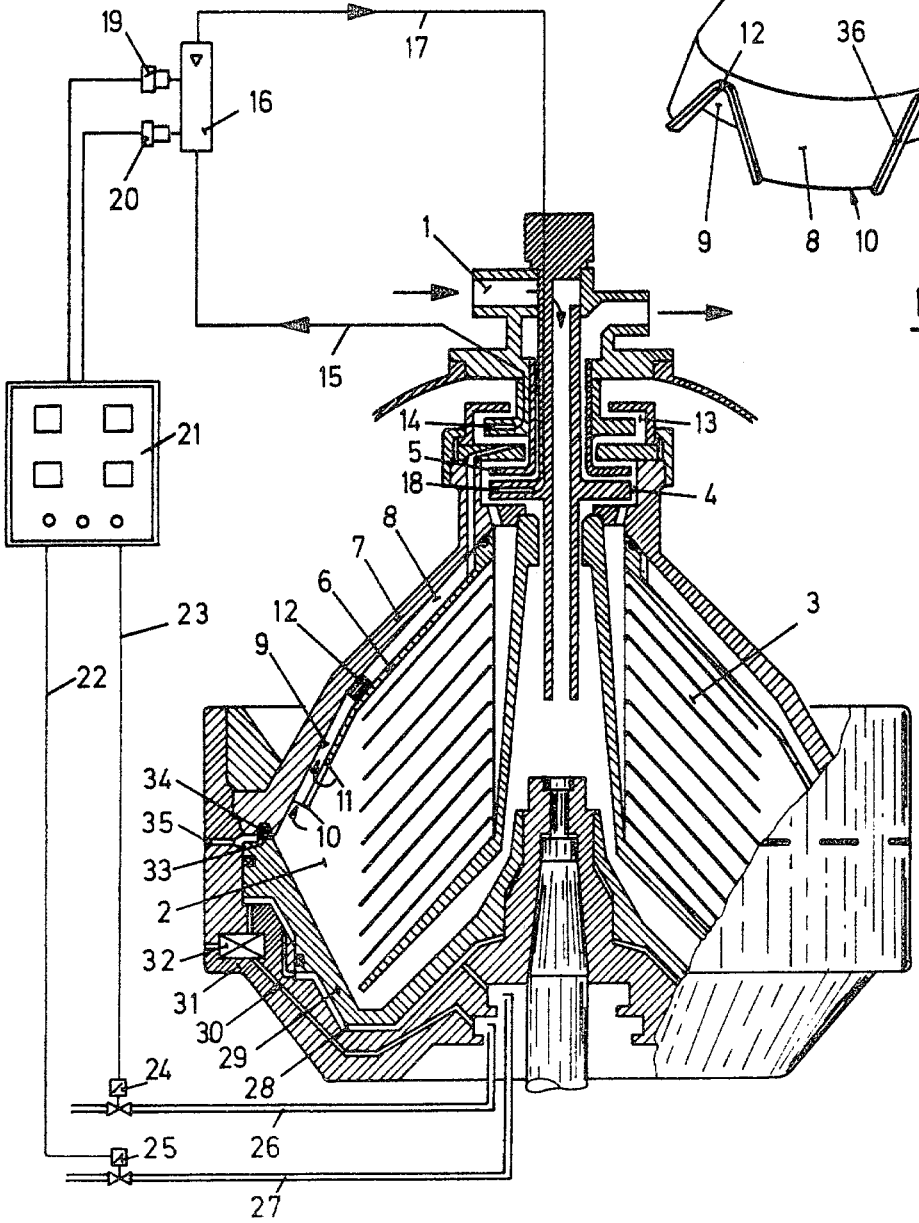
FIG. 1 is a cross-section of the self-emptying clarifying drum.

In FIG. 1, the numeral 1 designates the inlet of the solids-containing liquid which is to be clarified. While the solid matter that is spun out after the liquid enters the drum is collecting in the separating chamber 2, the clarified liquid flows through the plate insert 3 into the paring chamber 4 whence it is removed by the paring disk 5 disposed in this paring chamber. During operation, a small portion of the clarified liquid is withdrawn from the separating chamber through the passages 8 and 9 formed by ribs and disposed between the separating plate 6 and the drum cover 7. While the entrance opening of passage 8 is disposed on the outer edge 10 of the separating plate, the entrance opening of passage 9 is situated on an edge 11 situated further inwardly on the separating plate. The passage 9 is connected with passage 8 by throttlers, i.e., small orifices or nozzles 12, liquid that flows from the passages 8 and 9 being brought together into the paring chamber 13 and being returned from there by the paring disk 14 disposed in this chamber, through outlet line 15, flow meter 16, and line 17, underneath the paring disk 5 through passage 18 into the paring chamber 4. This returned small amount of liquid is carried out of this paring chamber together with the larger amount of clarified liquid by the paring disk 5.

The flow meter 16 has two actuation points 19 and 20 and communicates with a control means 21 which in turn through lines 22 and 23 controls valves 24 and 25 in the control liquid lines 26 and 27 for the closing and opening operations of the drum. For the closing operation, control liquid is introduced through line 27 into the chamber 28 beneath the control piston 29, the liquid pressure underneath the control piston being greater than the liquid pressure produced above the control piston by the liquid that is in the separating chamber of the drum. For the opening operation, control liquid is fed through line 26 into passage 30 and operates a valve 32 disposed in the drum body 31, this valve letting out the liquid that is in chamber 28 beneath the control piston, so that the liquid pressure above the control piston overcomes the liquid pressure below the control piston and opens the discharge gap 33 between the control piston 29 and the sealing ring 34 in the drum cover 7, so that the solid matter gathered in the separating chamber 2 can be discharged through openings 35 in the drum body 31.

Figure 2:
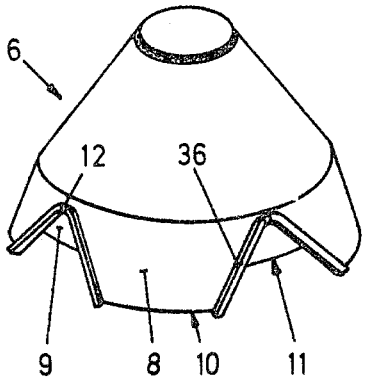
FIG. 2 is a perspective view of the separating plate formed with different channels.

FIG. 2 is a perspective view of the separating plate 6 having the ribs 36 on the exterior of the separating plate, which divide the space between the separating plate and drum cover 7 into larger passages 8 whose inlet edge 10 is on a larger diameter, and smaller passages 9 having an inlet edge 11 located further inwardly. The apertures or nozzles 12 disposed in the ribs 36 connect the passage 9 with passage 8.

THE MANNER OF OPERATION OF THE SELF-EMPTYING CLARIFYING DRUM

During operation, a small amount of clarified liquid flows from the separating chamber 2 over the outer and inner edges 10 and 11 of the separating plate 6 into the passages 8 and 9 and collects in the paring chamber 13 from which it is fed by the paring disk 14 disposed therein through the flow meter 16 and back to the drum and into the paring chamber 4. As soon as the solid matter that has collected in the separating chamber 2 has reached and risen above the outer edge 10 of the separating plate, the passage 8 is blocked so that liquid can be carried out only through passage 9 over the inner edge 11. Since a throttler is disposed in this passage, i.e., a small orifice or nozzle 12, a still lesser amount of liquid continues to flow into the paring chamber 13 from which it is delivered by the paring disk 14 to the flow meter 16. As the liquid flow diminishes, the measuring cone in the flow meter will sink and reach the first actuation point 19, whereupon the control apparatus 21 will give a pulse for the partial or complete emptying of the drum. This will be the case whenever solids of dense consistency are to be discharged. If, however, solids of bulky consistency are removed, the separating process can be continued until the inner edge 11 of the separating plate is reached and thus also passage 9 is blocked by solid matter. Since then there is no flow in the flow meter, the second actuation point 20 is reached by the measuring cone and a corresponding pulse is given to the control apparatus for the emptying process.

The control apparatus must, of course, be adjusted to the kinds of solids which are present and are to be separated.

It is furthermore conceivable to provide the separating plate with three or more passages at different diameters and to provide corresponding actuation points in the flow meter.

It will be appreciated that the instant specification and claims are set forth by way of illustration and not limitation, and that various modifications and changes may be made without departing from the spirit and scope of the present invention.

What is claimed is:

1. In a self-emptying clarifying drum of the type having a substantially frusto-conical separating plate, a first paring disk disposed in a first paring chamber for the removal of the clarified liquid, automatically operating means for sensing the solids level in the separating chamber of the drum and means including the separating plate and drum cover for providing liquid communication between the separating chamber and a second paring chamber provided with a second paring disk for the removal of a small portion of the clarified liquid, the outlet passage of the second paring disk being in communication with the outlet for the clear phase and connected to flow measuring means which is coactive with control means for effecting discharge of solid matter from the drum, the improvement wherein the means providing liquid communication includes means forming at least one first passage for the removal of a small portion of the clarified liquid having an inlet of first cross section disposed at the outer periphery of the separating plate and at least one second passage having the inlet thereof disposed radially inwardly of the inlet of the first passage and having an outlet radially inwardly of the second passage inlet and having a smaller cross section than the first cross section, the first passage being in communication with the outlet of the second passage and the portion of the clarified liquid which is to be removed through these passages being led through the flow measuring means by the second paring disk disposed in the second paring chamber and wherein the flow measuring means has means provided with switch actuating points for effecting control in dependence on the consistency of the solid material.

2. The drum according to claim 1, wherein the means forming the first and second passages comprises ribs disposed on the separating plate between the separating plate and drum cover.

3. The drum according to claim 1 or claim 2, further comprising a calibrated outlet orifice disposed at the outlet of each of the second passages and through which the first and second passages communicate.

* * * * *